US005223901A

United States Patent [19]

Endo et al.

[11] Patent Number: 5,223,901

[45] Date of Patent: Jun. 29, 1993

[54] FIXING DEVICE WITH TEMPERATURE COMPENSATION IN AN IMAGE FORMING APPARATUS

[75] Inventors: Hirohisa Endo, Higashiosaka; Yasunori Ueno, Itami, both of Japan

[73] Assignee: Mita Industrial Co., Ltd., Osaka, Japan

[21] Appl. No.: 860,451

[22] Filed: Mar. 30, 1992

[30] Foreign Application Priority Data

Apr. 4, 1991 [JP] Japan ..... 3-71920

[51] Int. Cl.[5] ..... G03G 15/20

[52] U.S. Cl. ..... 355/285; 219/216; 355/282; 432/60

[58] Field of Search ..... 355/282, 285, 289, 290, 355/291, 295, 208; 219/216, 469; 432/60

[56] References Cited

U.S. PATENT DOCUMENTS

| | | | |
|---|---|---|---|
| 3,765,828 | 10/1973 | Lux | 219/216 X |
| 4,001,545 | 1/1977 | Wada et al. | 432/60 X |
| 4,309,591 | 1/1982 | Kanoto et al. | 219/216 |
| 4,618,240 | 10/1986 | Sakurai et al. | 432/60 X |
| 4,780,078 | 10/1988 | Masui | 432/60 |
| 5,115,119 | 5/1992 | Adachi et al. | 219/469 |

FOREIGN PATENT DOCUMENTS

| | | | |
|---|---|---|---|
| 0055676 | 3/1986 | Japan | 355/285 |
| 63-54161 | 4/1988 | Japan . | |
| 1-285973 | 11/1989 | Japan . | |
| 0163784 | 6/1990 | Japan | 355/286 |
| 0033881 | 2/1991 | Japan | 355/289 |

*Primary Examiner*—A. T. Grimley
*Assistant Examiner*—William J. Royer
*Attorney, Agent, or Firm*—Renner, Otto, Boisselle & Sklar

[57] ABSTRACT

A fixing device for an image forming apparatus comprising a heat roller including a hollow roller body and a heater mounted through the roller body. The heater has a plurality of heating portions arranged at equal intervals along the axis thereof. The heater is shifted in the direction opposite to an air flow generated by an exhaust fan with respect to a recording-sheet contact area of the roller body so as to heat the end portion of the roller body located upstream of the air flow sufficiently enough to compensate for the drop of the temperature at the end portion of the recording-sheet contact area located upstream of the air flow cooled below a predetermined temperature by the unheated air flow.

18 Claims, 9 Drawing Sheets

FIXING DEVICE WITH TEMPERATURE COMPENSATION IN AN IMAGE FORMING APPARATUS

BACKGROUND OF THE INVENTION

1. Field of the Invention

The present invention relates to a fixing device disposed in an image forming apparatus such as an electrophotographic copying machine and a printer, and more particularly, relates to a fixing device comprising a pressure roller and a heat roller between which a recording sheet having a toner image transferred thereon is conveyed so that the toner image can be fixed to the recording sheet.

2. Description of the Prior Art

In an electrophotographic copying machine, a photosensitive drum is charged and exposed to the light reflected from an original so that an electrostatic latent image corresponding to an image on the original can be formed thereon. The electrostatic latent image is then developed using toner. The toner image formed on the photosensitive drum is transferred to a recording sheet by a transferring device, and the transferred toner image is then fixed to the recording sheet by a fixing device.

A conventional fixing device as shown in FIG. 9 generally comprises a heat roller 110 including a rotatable roller body 111 and a heater 112 mounted through the roller body 111 and a pressure roller 120 for pressing the roller body 111. The heater 112 of the heat roller 110 includes a plurality of heating portions 113 arranged at equal intervals along the axis of the heat roller 110 in such a manner that a recording-sheet contact area S on the circumferential surface of the roller body 111 which directly contacts a recording sheet can be heated uniformly in the axial direction of the heat roller 110. Therefore, the distance between one of the end faces of the heater 112 and one of the ends of the recording-sheet contact area S nearer to the above end face and the distance between the other end face of the heater 112 and the other end of the area S are equal, as is shown as a in FIG. 9. When the recording sheet is conveyed between the rollers, a toner image on the recording sheet is heated by the surface of the roller body 111 of the heat roller 110, and, at the same time, the toner image is pressed to the recording sheet by the pressure of the heat roller 110 and the pressure roller 120, so that the toner image is fixed to the recording sheet.

An electrophotographic copying machine comprising the above-described conventional fixing device is provided with an exhaust fan 90 so as to prevent a temperature rise in the machine caused by the heating of the heat roller 110. When the exhaust fan 90 is disposed on one side of the heat roller 110 as shown in FIG. 9, the air around the heat roller 110 flows in the axial direction of the heat roller 110 toward the exhaust fan 90 shown by arrow D and is exhausted outside the machine through the exhaust fan 90, without convecting inside the machine.

In the above-described structure, however, the air located upstream of the air flow with respect to the end face of the roller body 111 located upstream of the air flow, which has not been heated by the heater 112, also moves toward the exhaust fan 90 and flows along the recording-sheet contact area S, thereby cooling the surface of the roller body 111. Especially, the surface of the end portion of the roller body 111 located upstream of the air flow which is directly cooled by the unheated air flow is not likely to be heated enough to reach a predetermined temperature by the heater 112 in the roller body 111.

Further, since the heater 112 mounted through the roller body 111 is not rotatable while the roller body 111 is rotated, the unheated air may enter inside the roller body 111 from a space formed between the end face of the roller body 111 located upstream of the air flow and the heater 112 mounted through the end face. As a result, the surface of the end portion of the roller body 111 located upstream of the air flow may be further cooled.

Curves of the calorific value of the heater 112 and the temperature of the surface of the roller body 111, both measured along the axis of the roller body 111, are shown in FIG. 9. As is apparent from the figure, the surface temperature of the end portion of the recording-sheet contact area S located upstream of the air flow has not reached the predetermined temperature. In such a fixing device, the toner on the receiving sheet conveyed between the heat roller 110 and the pressure roller 120 will not be heated sufficiently. As a result, the toner may not be fixed well to the receiving sheet, or the toner may attach to the surface of the heat roller 110.

Japanese Laid-Open Utility Model Publication No. 63-54161 discloses a fixing device in which a heater in a heat roller can be shifted along the axis of the heat roller by means of a solenoid or a motor so that, when a smaller-size recording sheet is conveyed to the heat roller, the end portion of the heat roller not in touch with the recording sheet is not heated. However, in the disclosed structure, when a large-size recording sheet covering the whole width of a recording-sheet contact area is used, the end portion of the area will be cooled by the air flow generated by an exhaust fan, causing the same trouble as described above.

Japanese Laid-Open Patent Publication No. 1-285973 discloses a fixing device in which a heater in a heat roller can be shifted along the axis of the heat roller in correspondence with the number of sheets or the time to be copied. However, the disclosed fixing device is not effective for preventing the end portion of an recording-sheet contact area from being cooled by the air flow generated by an exhaust fan.

An objective of the present invention is to provide a fixing device ensuring the complete fixation of a toner image to a recording sheet by preventing the end portion of a recording-sheet contact area of a heat roller located upstream of an air flow from being cooled by the air flow inside the heat roller and along the surface thereof.

Another objective of the present invention is to provide a fixing device realizing a uniform temperature at the surface of the recording-sheet contact area of the heat roller along the axis thereof.

SUMMARY OF THE INVENTION

The fixing device for an image forming apparatus of this invention overcomes the above-discussed and numerous other disadvantages and deficiencies of the prior art. The fixing device includes a heat roller and a pressure means for pressing the heat roller, so that, while a recording sheet having a toner image transferred thereon is conveyed between the heat roller and the pressure means, the toner image is heated and pressed so as to be fixed to the recording sheet; wherein the heat roller comprises: a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow.

In a preferred embodiment, the heater is shifted in the direction opposite to the air flow with respect to the recording-sheet contact area of the roller body from a position in which the recording-sheet contact area receives almost equal calorific values along the axis thereof from the heater except for the end portions thereof.

In a preferred embodiment, the heater has a plurality of heating portions arranged at equal intervals in the axial direction of the roller body.

In a preferred embodiment, the heater is shifted in the direction opposite to the air flow with respect to the recording-sheet contact area of the roller body from a position in which the recording-sheet contact area receives almost equal calorific values along the axis thereof from the heater.

In a preferred embodiment, the heater is constructed so that the recording-sheet contact area of the roller body receives substantially almost equal calorific values along the axis thereof from the heater, and the heater is shifted in the direction opposite to the air flow with respect to the recording-sheet contact area from a position in which the recording-sheet contact area receives substantially almost equal calorific values along the axis thereof from the heater.

In a preferred embodiment, the heater has a plurality of heating portions arranged at equal intervals in the axial direction of the roller body, and the outermost heating portion located upstream of the air flow has a larger calorific value than the other heating portions.

In a preferred embodiment, the heating portions except for the outermost heating portions have gradually reduced calorific values in the direction of the air flow.

In a preferred embodiment, the heating portions have gradually reduced calorific values in the direction of the air flow.

In a preferred embodiment, the heating portions except for the outermost heating portions are arranged so that the recording-sheet contact area of the roller body receives equal calorific values along the axis thereof from the heater except for the end portions thereof, while the outermost heating portion located upstream of the air flow is extended in the direction opposite to the air flow.

In a preferred embodiment, the heating portions except for the outermost heating portion located upstream of the air flow are arranged so that the recording-sheet contact area of the roller body receives equal calorific values along the axis thereof from the heater except for the end portion thereof located upstream of the air flow, while the outermost heating portion located upstream of the air flow is extended in the direction opposite to the air flow.

In a preferred embodiment, the heater is arranged so that the calorific values of the end portion of the recording-sheet contact area of the roller body located upstream of the air flow and the end portion of the roller body adjacent thereto are larger than those of the other portions of the roller body.

In a preferred embodiment, the heater has a plurality of heating portions arranged at equal intervals in the axial direction of the roller body, and the outermost heating portion located upstream of the air flow heats the end portion of the recording-sheet contact area of the roller body located upstream of the air flow and the end portion of the roller body adjacent thereto.

In a preferred embodiment, the heating portions except for the outermost heating portions have gradually reduced calorific values in the direction of the air flow, and the calorific value of the outermost heating portion located downstream of the air flow is larger than that of the heating portion adjacent thereto.

In a preferred embodiment, the heating portions except for the outermost heating portion located upstream of the air flow have gradually reduced calorific values in the direction of the air flow.

In a preferred embodiment, the heating portions except for the outermost heating portions have almost equal calorific values, and the calorific value of the outermost heating portion located downstream of the air flow is larger than that of the heating portion adjacent thereto.

In a preferred embodiment, the heating portions except for the outermost heating portion located upstream of the air flow have almost equal calorific values.

According to the fixing device of the present invention, the end portion of the roller body of the heat roller located upstream of the air flow is heated by the heater mounted through the roller body so as to compensate for the cooling of the end portion of the recording-sheet contact area of the roller body by the unheated air flow.

Thus, the fixing device of the present invention makes possible the objectives of (1) ensuring the complete fixation of a toner image to a recording sheet, and (2) realizing a uniform temperature at the surface of the recording-sheet contact area along the axis thereof.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

EXAMPLE 1

Figure 2:
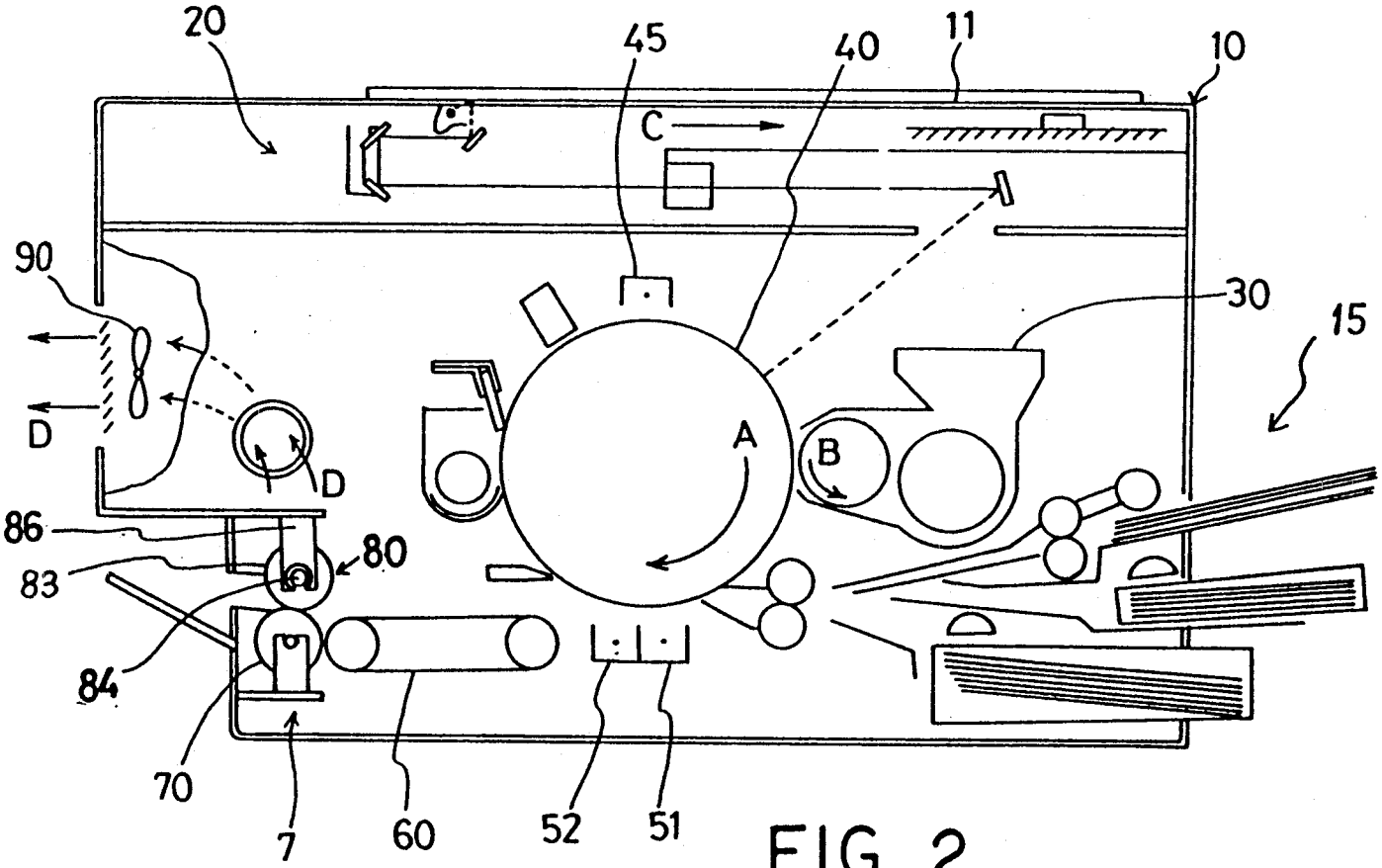
FIG. 2 is a sectional view illustrating the entire structure of a copying machine including a fixing device of the present invention.

FIG. 2 is a copying machine provided with a fixing device of the present invention. The copying machine comprises a body 10 including a photosensitive drum 40 disposed in the center thereof. The circumferential surface of the photosensitive drum 40 is charged by a charging device 45 disposed above the photosensitive drum 40. The charged surface of the photosensitive drum 40 is exposed to the light reflected from an original mounted on an original table 11 by means of an optical system 20 so that an electrostatic latent image corresponding to an image on the original can be formed on the surface of the photosensitive drum 40. The electrostatic latent image formed on the photosensitive drum 40 is developed with toner by a developing device 30 disposed on one side of the photosensitive drum 40. The toner image on the photosensitive drum 40 is transferred to a recording sheet conveyed from a sheet feed portion 15 by a transfer device 51. The recording sheet having the toner image thereon is separated from the photosensitive drum 40 by a separating device 52 and then conveyed to a fixing device 7 of the present invention by a conveying device 60.

The fixing device 7 of the present invention comprises a pressure roller 70 and a heat roller 80 disposed on the pressure roller 70 so that these rollers are pressed against each other. The rollers 70 and 80 are positioned in the direction across the body 10 of the copying machine perpendicular to the recording-sheet conveying direction. The recording sheet with the toner image thereon is conveyed between the rollers 70 and 80.

An exhaust fan 90 is disposed above the fixing device 7 in the rear portion of the body 10 of the copying machine so that the air around the heat roller 80 of the fixing device 7 heated by the heat roller 80 can flow in the axial direction of the heat roller 80 toward the exhaust fan 90 to be exhausted outside the body 10 of the copying machine through the exhaust fan 90.

Figure 1:
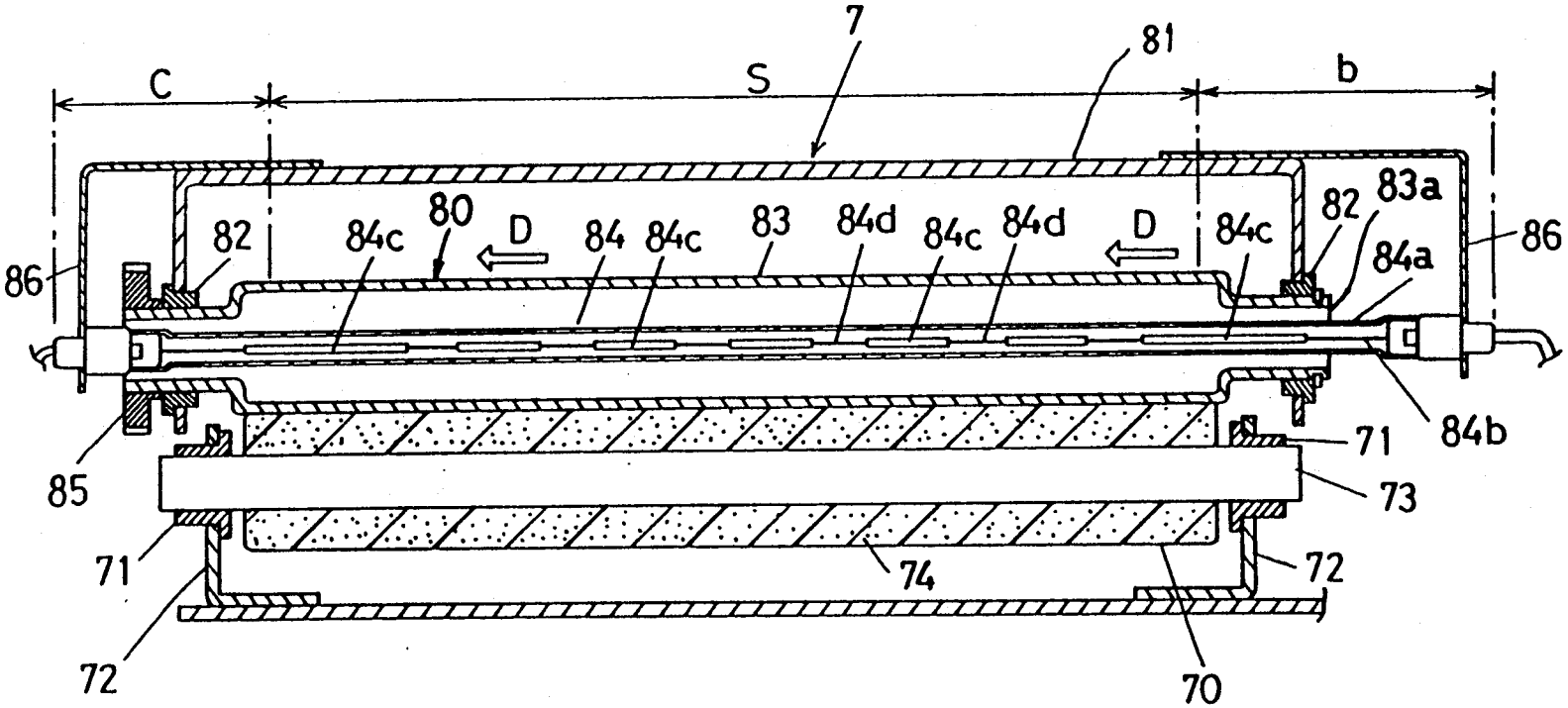
FIG. 1 is a detailed sectional view of a fixing device according to the present invention.

Referring to FIG. 1, the pressure roller 70 of the fixing device 7 comprises a roller body 74 made of an elastic member such as urethane rubber and a rotating axis 73 mounted through the roller body 74 so as to rotate with the roller body 74. Each end of the rotating axis 73 is rotatably supported by a bracket 72 fixed to the body 10 of the copying machine through a bush 71.

The heat roller 80 disposed on the pressure roller 70 comprises a hollow roller body 83 of which each end is rotatably supported by a support 81 fixed to the body 10 of the copying machine through a bush 82. The heat roller 80 also comprises a heater 84 mounted through the center of the roller body 83. The outer circumferential surface of the roller body 83 except for the end portions thereof to which the bushes 82 are attached is pressed by the outer circumferential surface of the roller body 74 of the pressure roller 70. The end portions of the roller body 83 are narrower than the other portions thereof, and their end faces are open. As described above, the air around the roller body 83 flows in the axial direction of the roller body 83 shown by arrow D in FIG. 1 toward the exhaust fan 90. This flow causes the air to enter inside the roller body 83 from the open end located upstream of the air flow.

A gear 85 is disposed on the narrow end portion of the roller body 83 located downstream of the air flow so as to receive a rotating force from a drive source disposed in the body 10 of the copying machine. The roller body 83 is rotated by the rotating force transmitted to the gear 85, and the pressure roller 70 pressing the roller body 83 is rotated together with the roller body 83.

The heater 84 mounted through the roller body 83 comprises a tube **84*a* of which each end is supported by a bracket 86 fixed to the support 81 supporting each end of the roller body 83 and a heating element 84*b* mounted through the tube 84*a*. The heating element 84*b* includes a plurality of heating portions 84*c* arranged at equal intervals along the axis of the heater 84 and a plurality of conducting portions 84*d* connecting adjacent heating portions 84*c*. The heating portions 84*c* are heated when the heating element 84*b* is electrified. The heating portions 84*c* have the same length in the axial direction except for the outermost ones located at the ends of the heating element 84*b* which are longer than the others. The calorific values of the heating portions 84*c* are proportional to the lengths thereof in the axial direction. Therefore, in this example, the calorific value of the outermost heating portions 84*c* is larger than that of the other heating portions 84*c***.

The heater 84 having the above-described structure can give almost uniform heating to a recording-sheet contact area S of the roller body 83 along the axis thereof except for the end portions thereof. In this example, the heater 84 is shifted in the direction opposite to the air flow with respect to the recording-sheet contact area S of the roller body 83 so that the outermost heating portion **84*c* located upstream of the air flow is partly positioned in the narrow end portion of the roller body 83. That is, the distance b between the end face of the heater 84 located upstream of the air flow and an end of the recording-sheet contact area S nearer to the above end face is larger than the distance c between the other end face of the heater 84 and the other end of the recording-sheet contact area S ($b>c$), as shown in FIG. 1**.

The operation of the above-described fixing device 7 will be described. The exhaust fan 90 starts driving when the heater 84 of the heat roller 80 is electrified. Therefore, while the roller body 83 is heated by the heating portions **84*c* of the heater 84, the air around the roller body 83 flows in the direction of arrow D in FIG. 1 toward the exhaust fan 90. At the same time, the unheated air located upstream of the air flow with respect to the end face 83*a* of the roller body 83 also moves toward the exhaust fan 90 and flows along the surface of the roller body 83 and inside thereof, cooling the end portion of the roller body 83** located upstream of the air flow.

As described above, the heater 84 is shifted in the direction opposite to the air flow with respect to the recording-sheet contact area S from the position where the heater 84 can give almost uniform heating to a recording-sheet contact area S along the axis thereof except for the end portions thereof. Therefore, the end portion of the roller body 83 located upstream of the air flow can be heated by the outermost long heat portion **84*c*** sufficiently enough to keep the temperature thereof from lowering below a fixed temperature by the unheated air flow.

The unheated air is heated at the end portion of the roller body 83 and continues to be heated during the flow along the heated surface of the roller body 83. In this way, the surface of the roller body 83 is prevented from being cooled below the fixed temperature. The heated air is then exhausted outside the body 10 of the copying machine through the exhaust fan 90 without convecting inside the body 10.

The surface of the roller body 83 of the heat roller 80 is heated as described above, and the roller body 83 and the pressure roller 70 are rotated together so as to allow the recording sheet with the toner image thereon to pass between the rollers 70 and 80. The toner image on the recording sheet is heated in contact with the surface of the roller body 83 and at the same time pressed to the recording sheet by the rollers 70 and 80, so as to be fixed to the recording sheet.

Figure 3:
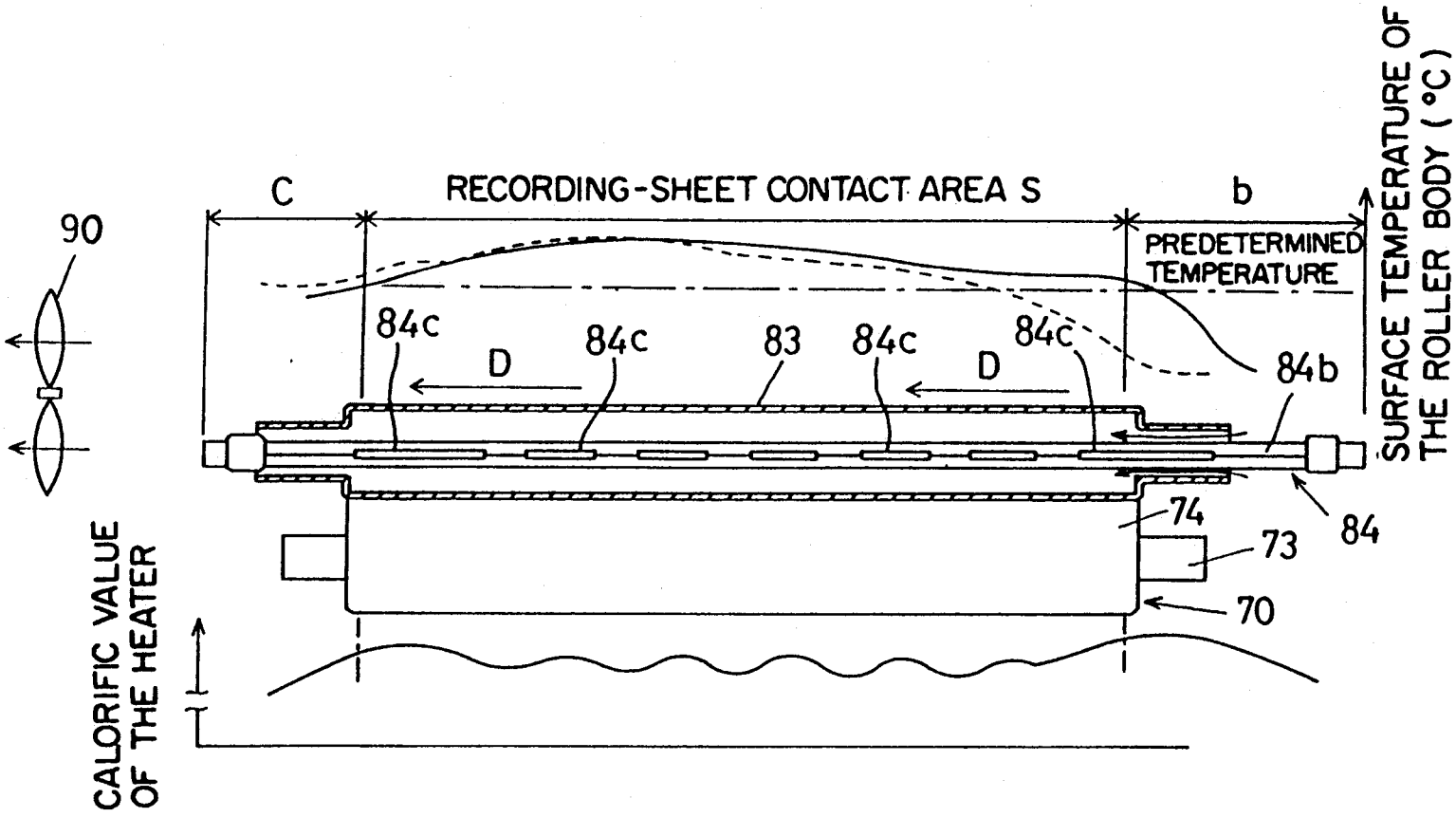
FIGS. 3 to 8 are sectional views of heat rollers of fixing devices of the first to sixth examples according to the present invention, the heat rollers in FIGS. 3, 4, 7 and 8 each being shown with the curves of the surface temperature of the roller body and the calorific value of the heater, and the heat rollers in FIGS. 5 and 6 each being shown with the curve of the calorific value of the heater.

Curves of the surface temperature of the roller body 83 and the calorific value of the heater 84, both measured along the axis of the roller body 83, are shown in FIG. 3. For comparison, the surface temperature of the roller body 111 of the conventional heat roller 110 measured along the axis thereof is shown by a dash line in the same figure. As is apparent from the figure, in this example, the entire surface of the recording-sheet contact area S of the roller body 83 has been heated above the fixed temperature, and the drop of the temperature at the end portion of the roller body 83 upstream of the air flow which is observed in the conventional heat roller has been overcome in this example.

EXAMPLE 2

Figure 4:
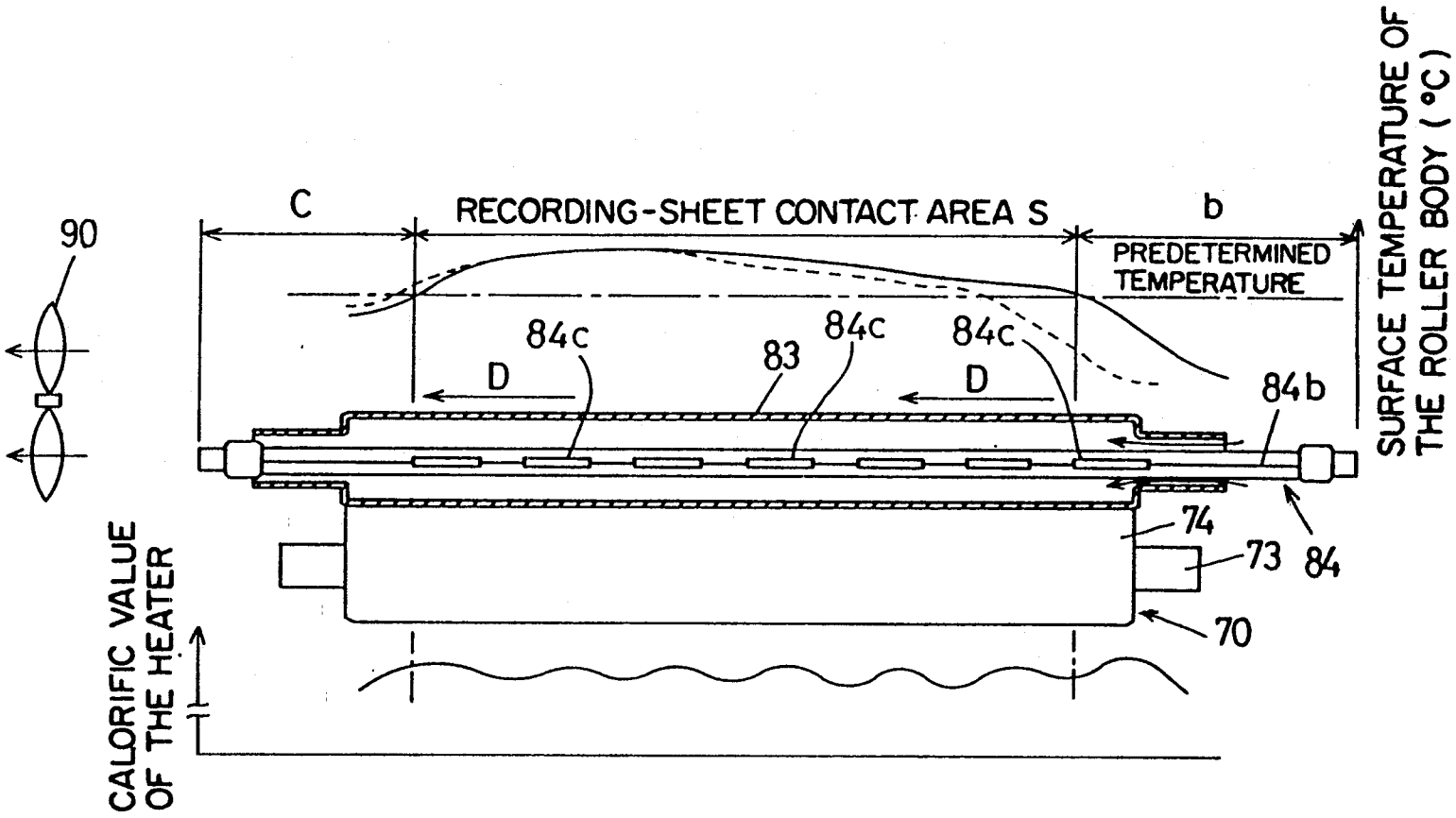

A second example of the present invention is shown in FIG. 4. In this example, the heating portions 84*c* of the heater 84 of the heat roller 80 have the same length in the axial direction of the heater 84 and are arranged at equal intervals along the axis thereof. The heater 84 is shifted in the direction opposite to the air flow with respect to the recording-sheet contact area S of the roller body 83. Other structures are the same as those of Example 1. In this example, the outermost heating portion 84*c* located upstream of the air flow heats the end portion of the roller body 83 located upstream of the air flow, compensating for the cooling of the end portion.

Curves of the surface temperature of the roller body 83 and the calorific value of the heater 84, both measured along the axis of the roller body 83, are shown in FIG. 4. In this example, as in Example 1, the temperature at the end portion of the recording-sheet contact area S upstream of the air flow is kept above the fixed temperature.

EXAMPLE 3

Figure 5:
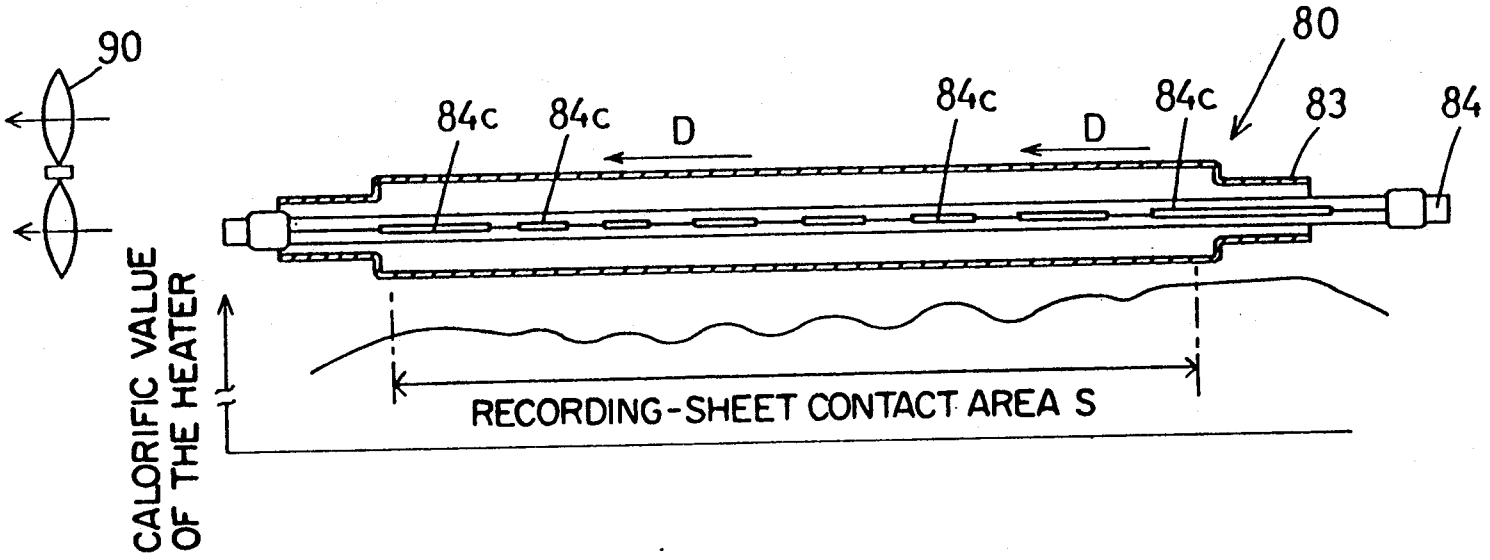

A third example of the present invention is shown in FIG. 5. In this example, the heating portions 84*c* of the heater 84 of the heat roller 80 except for the outermost ones are gradually shortened in the direction of the air flow. The heater 84 is shifted in the direction opposite to the air flow with respect to the recording-sheet contact area S of the roller body 83. Other structures are the same as those of Example 1. In this example, the heating of the air flow inside the roller body 83 is gradually reduced, thereby preventing the excess heating of the air during the flow inside the roller body 83.

EXAMPLE 4

Figure 6:
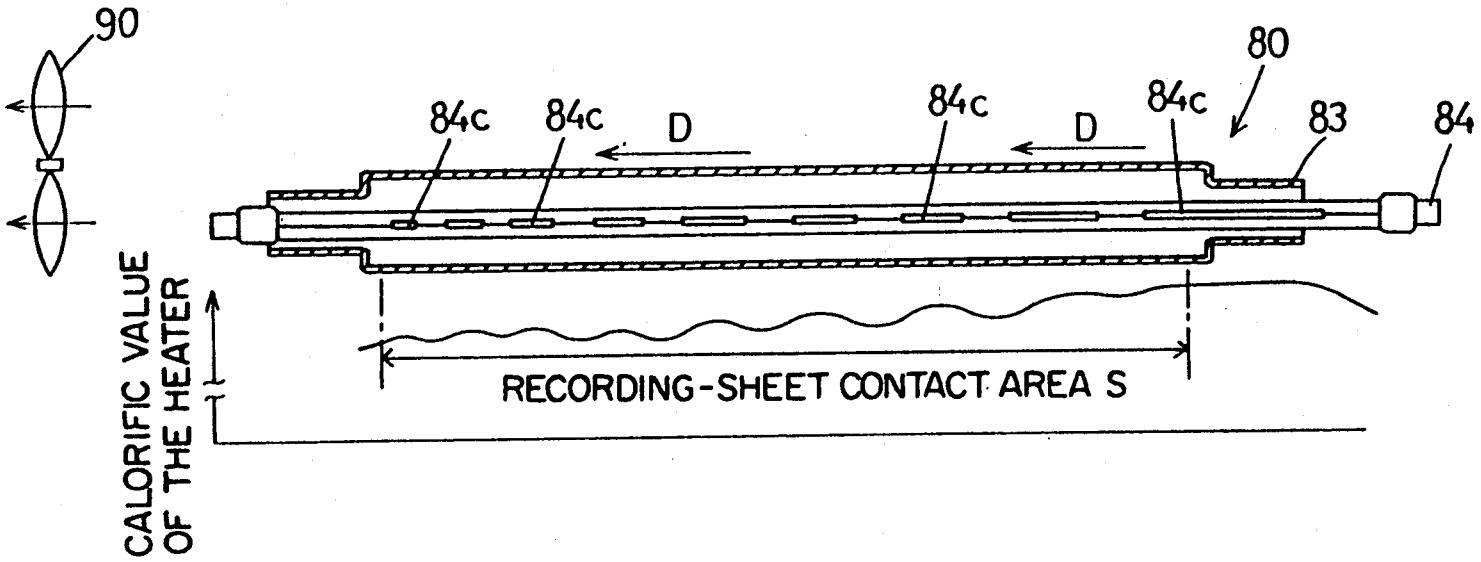

A fourth example of the present invention is shown in FIG. 6. In this example, all of the heating portions 84*c* of the heater 84 of the heat roller 80 are gradually shortened in the direction of the air flow. Other structures are the same as those of Example 5. In this example, the surface temperature of the roller body 83 is made further uniform by the air flow along the surface of the roller body 83 and the inside thereof.

EXAMPLE 5

Figure 7:
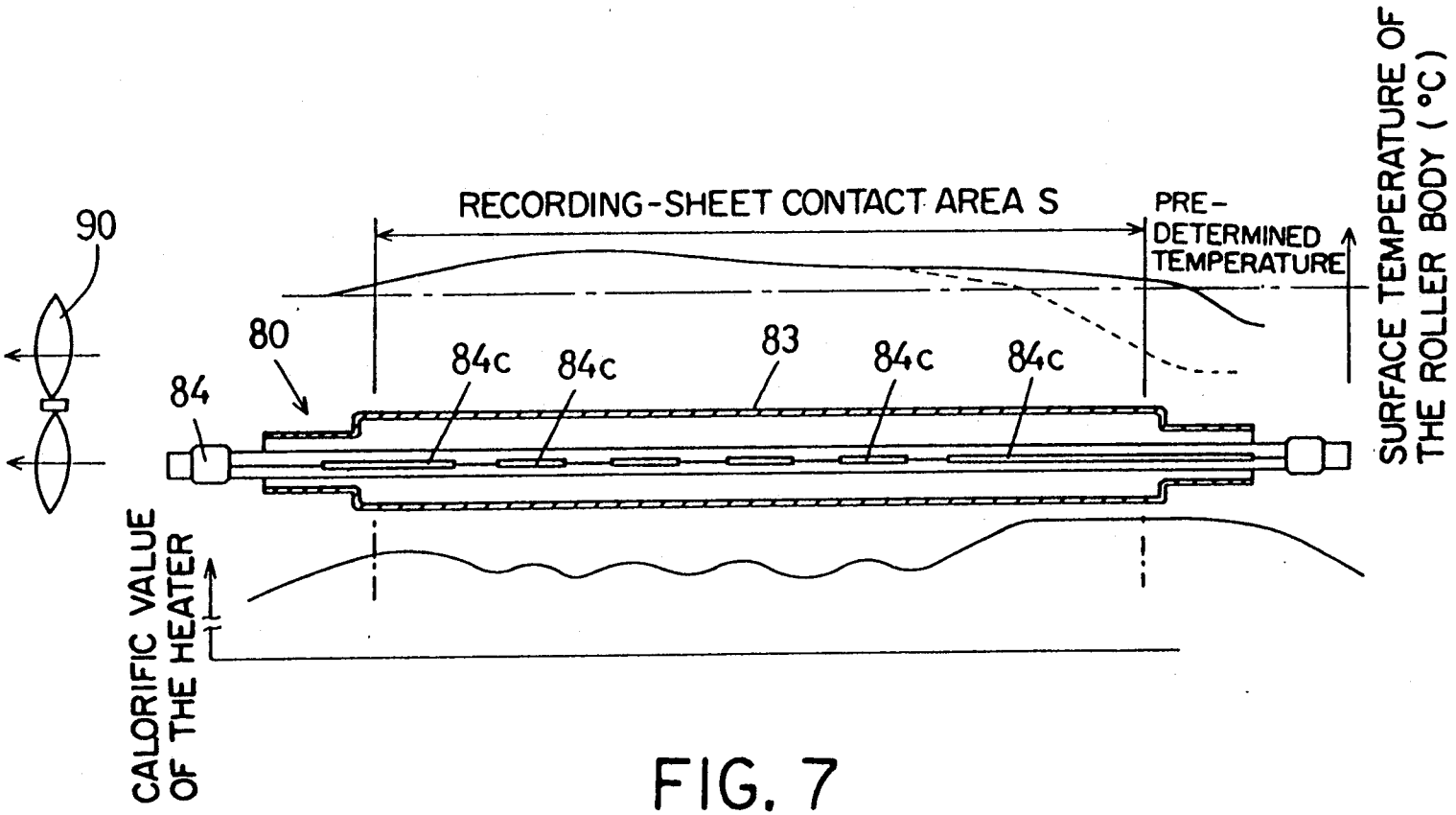

A fifth example of the present invention is shown in FIG. 7. In this example, the heating portions 84*c* of the heater 84 of the heat roller 80 except for the outermost ones have the same length. Unlike the former examples, the heater 84 of this example is not shifted with respect to the recording-sheet contact area S of the roller body 83, but the outermost heating portion 84*c* of the heater 84 located upstream of the air flow is made longer than the other outermost heating portion 84*c* so as to extend to the end portion of the roller body 84 upstream of the air flow. Other structures are the same as those of Example 1.

The surface temperature of the roller body 83 and the calorific value of the heater 84, both measured along the axis of the roller body 83, are shown in FIG. 7. As is apparent from the figure, the calorific value of the heating portion 84*c* located upstream of the air flow is sufficiently larger than that of the other heating portions 84*c*, so that the end portion of the recording-sheet contact area S located upstream of the air flow can be heated sufficiently enough to prevent the portion from being cooled below the fixed temperature.

EXAMPLE 6

Figure 8:
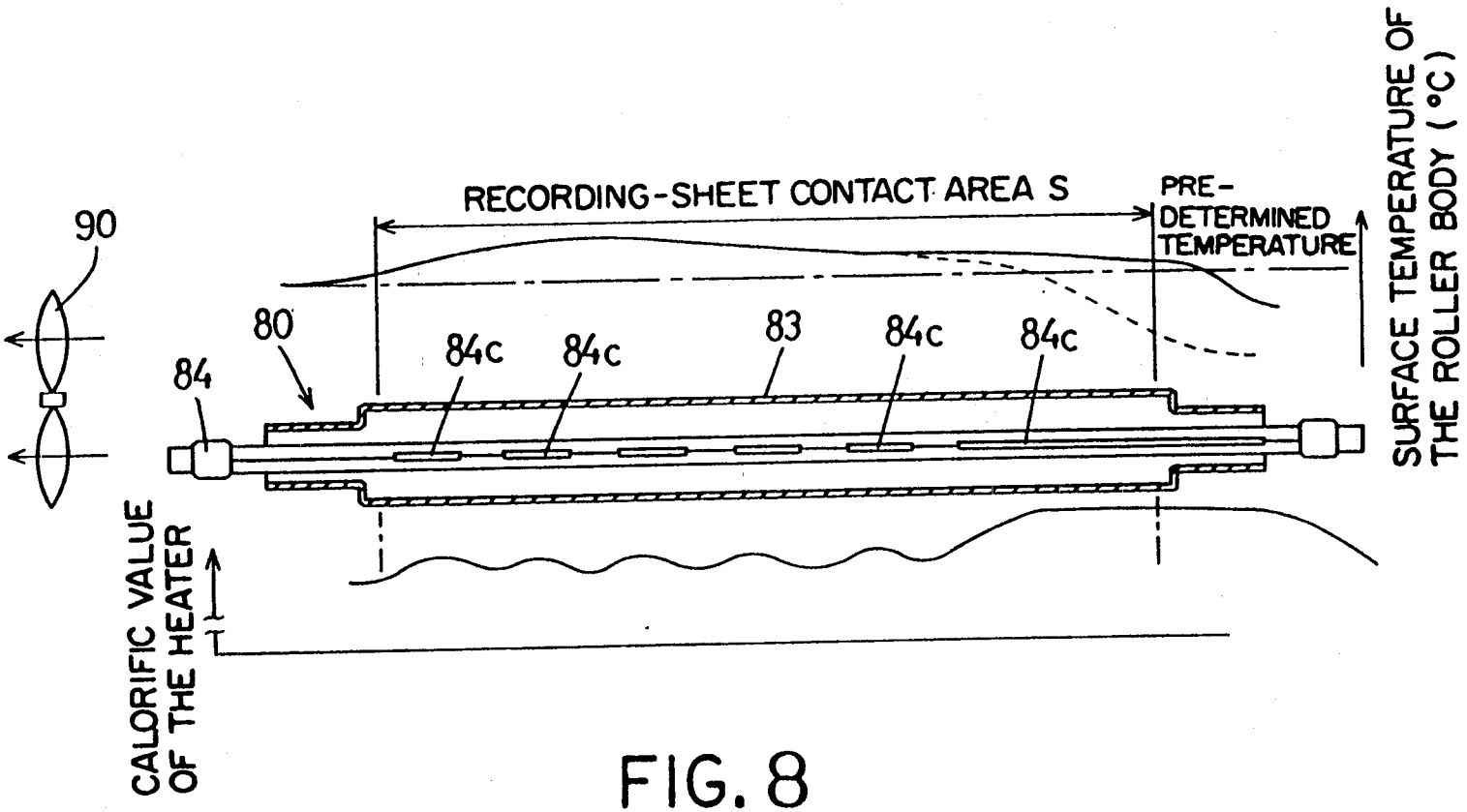
Figure 9:
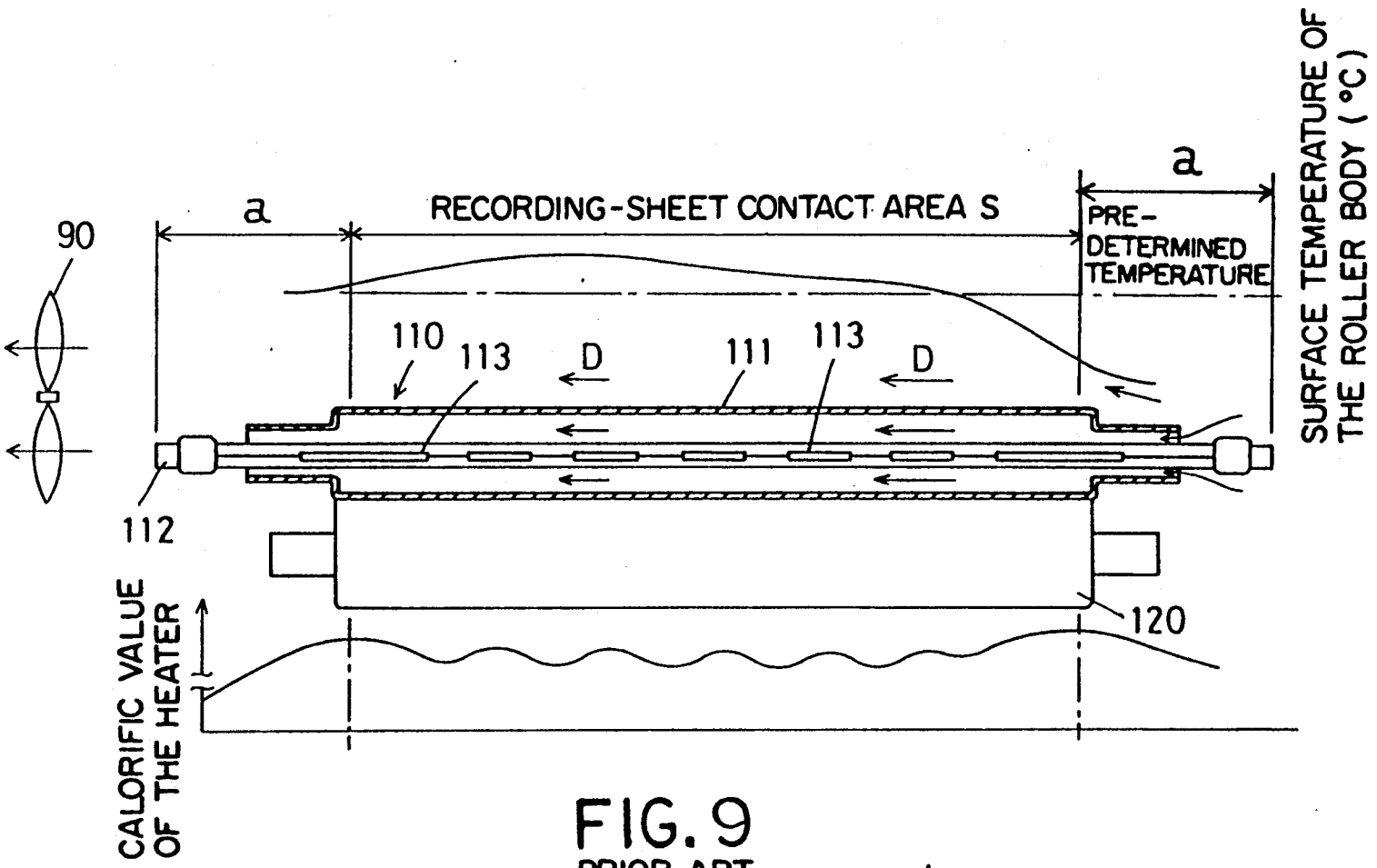
FIG. 9 PRIOR ART
FIG. 9 is a sectional view of a conventional fixing device, shown with the curves of the surface temperature of the roller body and the calorific value of the heater.

A sixth example of the present invention is shown in FIG. 8. In this example, the outermost heating portion 84*c* located downstream of the air flow has the same length as the adjacent heating portion 84*c*. Other structures are the same as those of Example 5. According to this example, the surface temperature of the roller body 83 is made further uniform.

In the above-described examples, the pressure roller 70 was used as a means for applying pressure against the heat roller 80 so as to fix the toner to the recording sheet, but a pressure belt may also be used for this purpose.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing one or more of the features of patentable novelty that reside in the present invention, including all features that would be treated as equivalents thereof by those skilled in the art to which this invention pertains.

What is claimed is:

1. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater is shifted in the direction opposite to the air flow with respect to the recording-sheet contact area of the roller body from a position in which the recording-sheet contact area receives almost equal calorific values along the axis thereof from the heater except for the end portions thereof.

2. A fixing device according to claim 1, wherein the heater has a plurality of heating portions arranged at equal intervals in the axial direction of the roller body.

3. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater is shifted in the direction opposite to the air flow with respect to the recording-sheet contact area of the roller body from a position in which the recording-sheet contact area receives almost equal calorific values along the axis thereof from the heater.

4. A fixing device according to claim 3, wherein the heater has a plurality of heating portions arranged at equal intervals in the axial direction of the roller body.

5. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater is constructed so that the recording-sheet contact area of the roller body receives substantially almost equal calorific values along the axis thereof from the heater, and the heater is shifted in the direction opposite to the air flow with respect to the recording-sheet contact area from a position in which the recording-sheet contact area receives substantially almost equal calorific values along the axis thereof from the heater.

6. A fixing device according to claim 5, wherein the heater has a plurality of heating portions arranged at equal intervals in the axial direction of the roller body.

7. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater has a plurality of heating portions arranged at equal intervals in the axial direction of the roller body, and the outermost heating portion located upstream of the air flow has a larger calorific value than the other heating portions.

8. A fixing device according to claim 7, wherein the heating portions except for the outermost heating portions have gradually reduced calorific values in the direction of the air flow.

9. A fixing device according to claim 7, wherein the heating portions have gradually reduced calorific values in the direction of the air flow.

10. A fixing device according to claim 7, wherein the heating portions except for the outermost heating portions are arranged so that the recording-sheet contact area of the roller body receives equal calorific values along the axis thereof from the heater except for the end portions thereof, while the outermost heating portion located upstream of the air flow is extended in the direction opposite to the air flow.

11. A fixing device according to claim 7, wherein the heating portions except for the outermost heating portion located upstream of the air flow are arranged so that the recording-sheet contact area of the roller body receives equal calorific values along the axis thereof from the heater except for the end portion thereof located upstream of the air flow, while the outermost heating portion located upstream of the air flow is extended in the direction opposite to the air flow.

12. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater is arranged so that the calorific values of the end portion of the recording-sheet contact area of the roller body located upstream of the air flow and the end portion of the roller body adjacent thereto are larger than those of the other portions of the roller body.

13. A fixing device according to claim 12, wherein the heater has a plurality of heating portions arranged at equal intervals in the axial direction of the roller body, and the outermost heating portion located upstream of the air flow heats the end portion of the recording-sheet contact area of the roller body located upstream of the air flow and the end portion of the roller body adjacent thereto.

14. A fixing device according to claim 13, wherein the heating portions except for the outermost heating portions have gradually reduced calorific values in the direction of the air flow, and the calorific value of the outermost heating portion located downstream of the air flow is larger than that of the heating portion adjacent thereto.

15. A fixing device according to claim 13, wherein the heating portions except for the outermost heating portion located upstream of the air flow have gradually reduced calorific values in the direction of the air flow.

16. A fixing device according to claim 13, wherein the heating portions except for the outermost heating portions have almost equal calorific values, and the calorific value of the outermost heating portion located downstream of the air flow is larger than that of the heating portion adjacent thereto.

17. A fixing device according to claim 13, wherein the heating portions except for the outermost heating portion located upstream of the air flow have almost equal calorific values.

18. A fixing device for an image forming apparatus, the device including a heat roller and a pressure means for pressing the heat roller, so that, while a recording sheet having a toner image transferred thereon is conveyed between the heat roller and the pressure means, the toner image is heated and pressed so as to be fixed to the recording sheet;

wherein the heat roller comprises:

a hollow roller body rotatably disposed in an air flow moving in a predetermined direction so that the axial direction of the roller body corresponds to the direction of the air flow; and a heater mounted through the roller body so that an end portion of the roller body located upstream of the air flow with respect to a recording-sheet contact area of the roller body is heated so as to compensate for a drop in the temperature at an end portion of the recording-sheet contact area located upstream of the air flow which has been cooled below a predetermined temperature by the air flow; and wherein the heater has heater portions arranged along a length extending along the axis of the heat roller within which at least the heat roller and pressure means are in contact with one another, and the center of the length of the heater portions is offset with respect to the center of the length of the roller body in the direction opposite to the air flow.

* * * * *